United States Patent [19]

Ehrlich

[11] 4,103,504

[45] Aug. 1, 1978

[54] OFFSHORE PLATFORM FOR ICE-COVERED WATERS

[76] Inventor: Norman A. Ehrlich, 138 A Eureka St., San Francisco, Calif. 94114

[21] Appl. No.: 840,275

[22] Filed: Oct. 7, 1977

[51] Int. Cl.[2] ..... E02D 31/00; E02B 15/02

[52] U.S. Cl. ..... 61/102; 61/104

[58] Field of Search ..... 61/1 R, 48, 102, 104; 114/40, 42

[56] References Cited

U.S. PATENT DOCUMENTS

| | | | |
|---|---|---|---|
| 355,214 | 12/1886 | Romaine | 114/40 |
| 2,915,879 | 12/1959 | Besse | 61/48 |
| 3,462,960 | 8/1969 | Bruehl | 61/48 |
| 3,696,624 | 10/1972 | Bennett | 61/102 |
| 3,717,115 | 2/1973 | Abendroth | 114/42 |
| 3,807,179 | 4/1974 | Stone | 61/102 X |

*Primary Examiner*—Mervin Stein
*Assistant Examiner*—David H. Corbin

[57] ABSTRACT

The invention introduces a semi-rigid interface between a moving ice field and a stationary offshore platform. The invention employs a plurality of cables which extend from points located around the periphery of the platform above the ice-covered water to corresponding points on the submerged portion of the structure, forming a protective shield of evenly spaced cables around the structure. The cables may then be caused to vibrate at predetermined frequencies, thereby reducing the frictional forces of the ice against the structure and additionally including a self-destructive natural frequency in the surrounding ice field. A compressible bladder or filler is used between the cables and the structure to prevent ice buildup behind the cables.

4 Claims, 4 Drawing Figures

OFFSHORE PLATFORM FOR ICE-COVERED WATERS

CROSS REFERENCES

1. U.S. Pat. No. 3,952,527 Apr. 27, 1976 Vinieratos, et. al 61/46.5
2. U.S. Pat. No. 3,793,840 Feb. 26, 1974 Mott, et. al 61/46.5

BACKGROUND OF THE INVENTION

The petroleum industry has gained much experience in the past decade in exploring and drilling for oil in offshore open water environments all over the globe. Drill ships, fixed platforms and semi-submersible moored platforms have been specially designed and constructed for exploring for offshore oil and producing oil from sub-sea fields.

The Arctic has recently become the focal point of interest because of the large onshore finds on the north slope. The U.S. Government has also predicted large but unproven oil fields on the outer Continental Shelf of Alaska and plans lease sales in the Bering, Chukchi and Beaufort Seas. Should the offshore fields in the Arctic be proven to be abundant, the oil industry will be required to construct offshore platforms which must withstand very large forces due to movements in the ice fields surrounding the structures. As an example, the Beaufort Sea Continental Shelf varies from 50 to 80 kilometers offshore. It consists of a flat shelf and a steep outer shelf deepening to about 36.5 meters at 18.5 kilometers offshore. Ice covers the Beaufort Sea for about nine months of the year. The inner zone of fast ice reaches a thickness of about 2 meters. However, seaward of this zone of fast ice lies Arctic pack ice containing 2 to 4 meter multi-year ice floes.

Conventional platforms designed and used in ice-free waters are incapable of withstanding the large lateral forces generated by large ice fields and ice floes. Moreover, it is beyond the present state-of-the-art to design deep water platforms for Arctic environments because of the yet undefinable character of an Arctic ice field. Arctic ice fields contain not only uniform ice sheets of certain physical properties but also contain single and multi-year pressure ridges which could have drafts as deep as 30 meters.

Currently, there are two proven methods for drilling offshore in the Arctic. These methods involve constructing either a gravel or ice island for use as a drilling platform. Both of these techniques are limited to shallow water depth up to approximately 10 meters. Beyond a 10 meter depth man-made ice or gravel islands become infeasible. Conventional deep water drilling platforms designed to withstand ice forces and overturning moments due to high ice forces would be, indeed, massive and expensive.

Attempts are being made to develop new methods of dealing with the problem of structures in ice-covered waters. One of the most simplistic and promising approaches is to design a structure with sloping sides in a conical configuration. This type of structure takes advantage of the fact that ice is much weaker in bending than it is in crushing by sloping the surface interface, thereby changing the force vector and inducing a bending-crushing mode of failure rather than a uniaxial crushing mode of failure. The resultant forces against the structure vary with the angle of the cone and the friction of the ice against the cone.

SUMMARY OF THE INVENTION

The invention consists of forming a sloping conical surface around a structure by employing a plurality of pre-tensioned cables regularly spaced around the periphery of the structure. The slope of the cables may be either positive or negative with respect to the plane of the ice field.

Behind the barrier of cables is a compressible bladder or compressible filler to prevent broken ice from encroaching beyond the cable barrier.

The invention contemplates means of vibrating the pre-tensioned cables at various frequencies and amplitudes. As is explained below, the use of vibrating cables is a major improvement over the state-of-the-art of conicalsided structures.

One objective of the invention is to reduce the friction between the ice and the structure by using cables which could be induced to vibrate. The effect of eliminating friction would be to significantly reduce the magnitude of the ice force against the structure.

A second objective of the invention is to reduce the ice loading on the structure by breaking up the ice field before it interacts with the structure. This may be accomplished by vibrating the cables at certain frequencies and amplitudes which induce natural or resonant frequencies in the adjacent ice field, thus impairing the structural integrity of the ice field around the structure.

A further objective of the invention is to reduce the size and weight and therefore construction and transportation costs of an Arctic structure, and also to provide an economical method of strengthening existing conventional offshore platforms for Arctic use.

DESCRIPTION OF THE PREFERRED EMBODIMENT

Figure 2:
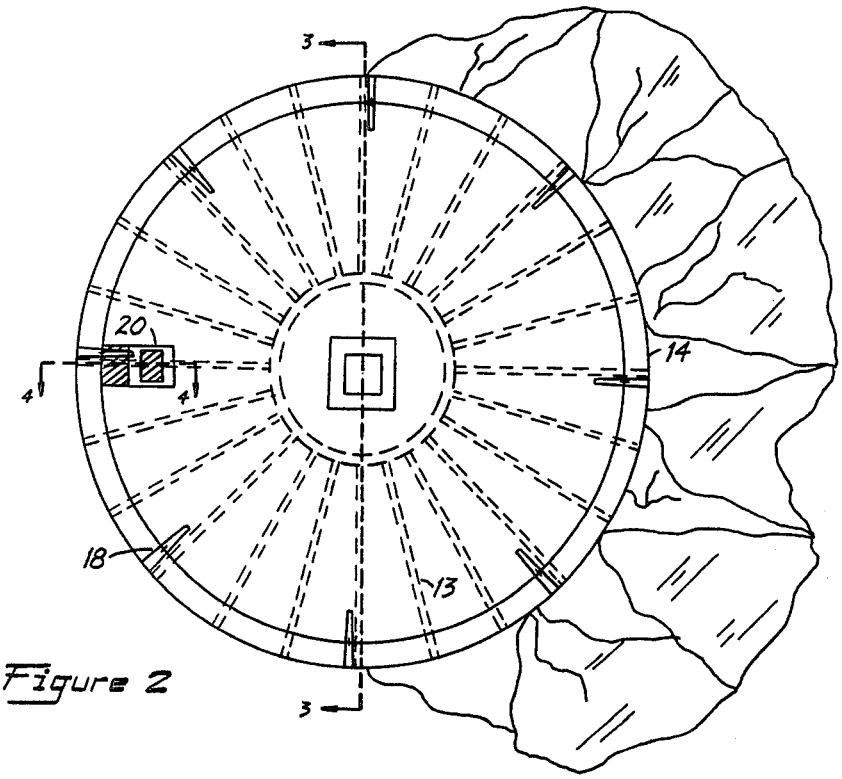
FIG. 2 is a top view of the structure showing how radial cracking of the ice will occur around the structure due to combined stress and vibration.
Figure 1:
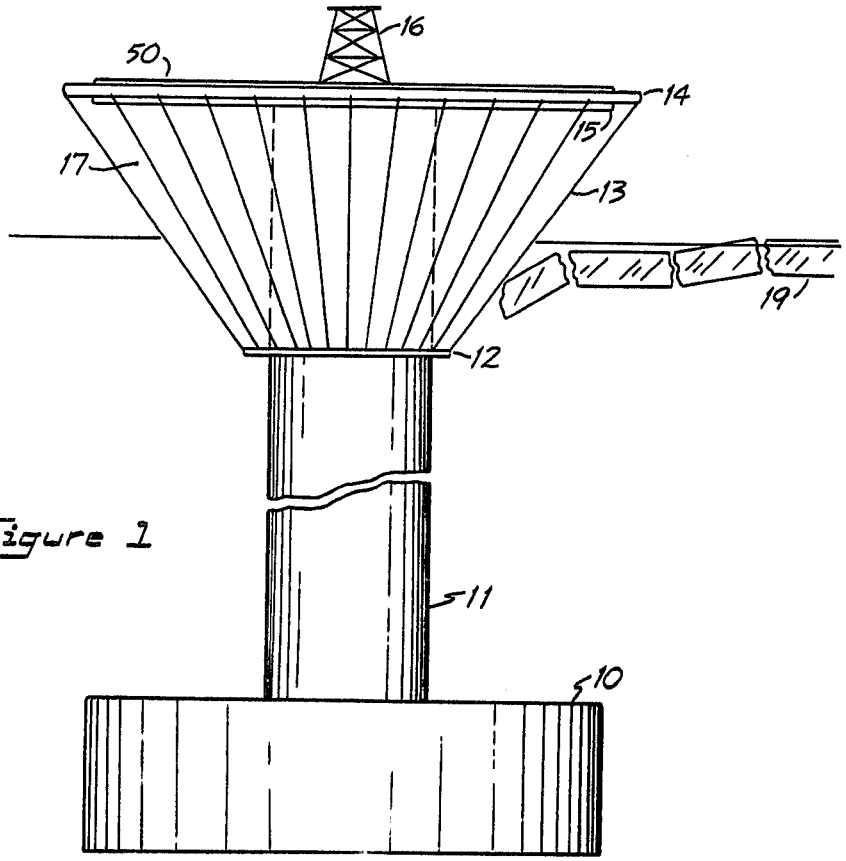
FIG. 1 is an elevation view showing the platform in position and illustrating how the ice will contact the cables and break before it contacts the structure.

Attention is directed to FIGS. 1 and 2 showing an offshore platform or structure generally designated as 50. The platform 50 is used to support drilling equipment and other support facilities and ancillary equipment generally designated as 16. The deck 15 is supported above the surface of the ice-covered water 19 by a single tubular vertical support 11 having a base 10. Other vertical support arrangements are possible depending on whether the structure is fixed or semi-submersible.

Affixed to the vertical support 11 is a collar 12 which is located beneath the surface of the ice-covered water 19. Dynamic tension ring 14 is supported around the periphery of the platform 50 by a plurality of horizontal members 18 located at various intervals around the deck 15.

A plurality of cables 13 are strung and tensioned between the collar 12 and the dynamic tension ring 14 at even angular increments. Typical means for adjusting the cable tension and inducing vibration are designated as 20. The number of cables, the tension, and the amplitude and frequency of vibration will be determined by the characteristics of the ice cover.

Figure 3:
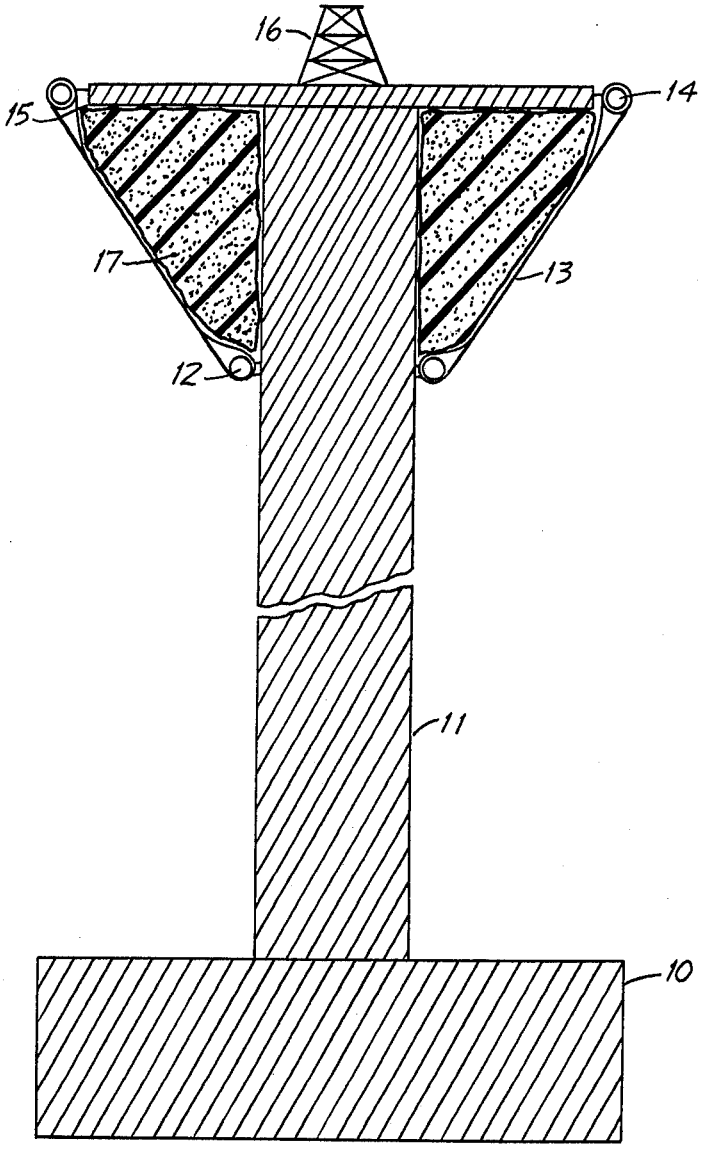
FIG. 3 is a plan cross sectional elevation view of the structure exposing a compressible filler between the cables and the structure.

Referring to FIG. 3, a compressible filler 17 is revealed by the cross section taken perpendicular to the deck 15. The filler 17 fills the void between the outside surface formed by the cables 13 and the vertical support 11. The filler can be made of a molded form, an air bag or a plurality of compressible units such as spheres or similar smaller elements. The purpose of the filler 17 is to prevent the volume within the boundaries of the cables 13 from filling up with broken ice fragments, thereby possibly transmitting the ice force to the vertical support 11.

Figure 4:
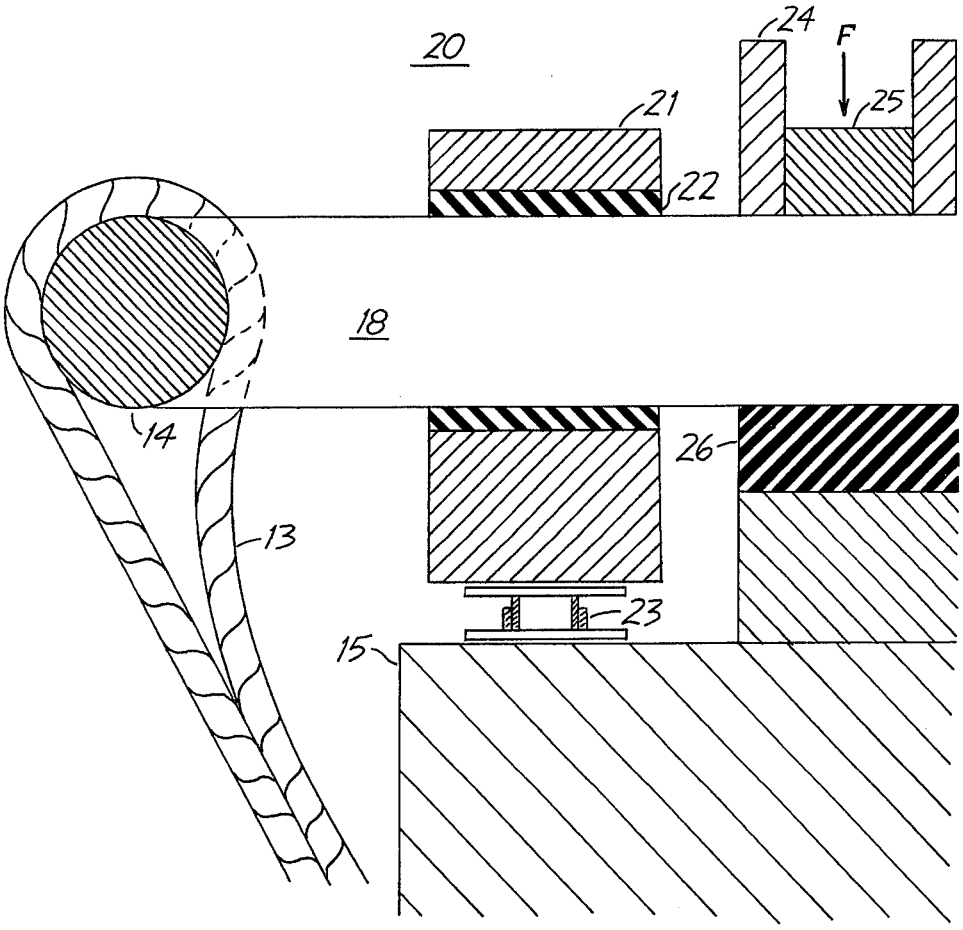
FIG. 4 is a detail cross section of a mounting support which can transfer vibration onto the cables.

FIG. 4 shows one configuration of a means for supporting the dynamic tension ring 14 and transmitting the desired vibration into the cables 13. Cables 13 are clamped tightly around the dynamic tension ring 14. Horizontal shaft 18 is welded to the dynamic tension ring 14 and extends through semi-rigid pillar block 21 having a compressible sleeve 22. The tension in cables 13 is adjusted by raising or lowering the pillar block 21 with screw jack 23 located between the deck 15 and pillar block 21.

The horizontal shaft 18 extends beyond the semi-rigid pillar block 21 towards the center of the deck 15, where it passes through a vibratory pillar block 24 which is rigidly fixed to the deck 15. This vibratory pillar block 24 has an elastic medium 26 beneath the shaft 18 and a piston 25 above the shaft. Piston 25 is capable of exciting shaft 18 by exerting a force on the shaft 18 with varying amplitudes and frequencies.

The preferred embodiment depicts the invention as a fixed offshore platform with a base 10 resting on the ocean floor. The preferred embodiment also includes a single vertical support 11 and shows cables 13 sloping inwardly in a positive direction with respect to the horizontal. Other variations of the same inventive concept are possible using moored or semi-submersible platforms having one or more vertical members. Also, the configuration of the platform 50, the collar 12 or the dynamic support ring 14 could be changed to change the slope of the cables 13 to vary the angle of the cables 13 with respect to the horizontal. One may even change the direction of the slope of the cables 13 from positive with respect to the horizontal to negative.

What is claimed is:

1. An offshore platform for resisting external ice forces and for supporting a deck and equipment comprising:

(a) a base,
(b) a support extending vertically from the base,
(c) a deck mounted on top of the support,
(d) means attached to the deck for securing cables,
(e) means attached to the support for securing cables,
(f) a plurality of cables attached to the deck securing means at one end and the support securing means at the other end,
(g) means for vibrating the securing means at either ends of the cable whereby the cables are caused to vibrate,
(h) means for adjusting the tension in the cables.

2. An offshore platform as recited in claim 1 further comprising:

(i) a compressible filler disposed within the cables thereby preventing ice pieces from building up between the cables and the support.

3. An offshore platform as recited in claim 1 wherein the means attached to the deck for securing the cables comprises:

(j) a dynamic support ring,
(k) a plurality of shafts rigidly attached to the support ring at one end and non-rigidly attached to the deck at the other end,
(l) means to raise and lower the shafts whereby the tension in the cables can be adjusted,
(m) means to vibrate the shafts.

4. An offshore platform as recited in claim 3 wherein said means to vibrate the shafts comprises:

(n) a semi-rigid pillar block through which each shaft extends,
(o) means mounted between the semi-rigid pillar block and the deck to adjust the height of the pillar block,
(p) a vibratory pillar block mounted on each shaft whereby forces of various frequencies and magnitudes are transmitted to the shaft.

* * * * *